United States Patent [19]

Dangeleit et al.

[11] 4,161,209

[45] Jul. 17, 1979

[54] APPARATUS FOR HANDLING THE STARTING STRAND OF A METAL STRAND CASTING PLANT

[75] Inventors: Siegfried Dangeleit, Krefeld; Dieter Kothe, Moers, both of Fed. Rep. of Germany

[73] Assignee: DEMAG Aktiengesellschaft, Duisburg, Fed. Rep. of Germany

[21] Appl. No.: 825,534

[22] Filed: Aug. 18, 1977

[30] Foreign Application Priority Data

Aug. 21, 1976 [DE] Fed. Rep. of Germany ..... 2637824

[51] Int. Cl.[2] ..... B22D 11/08

[52] U.S. Cl. ..... 164/446

[58] Field of Search ..... 164/446, 447, 445, 82, 164/425, 426, 448, 269

[56] References Cited

U.S. PATENT DOCUMENTS

| | | | |
|---|---|---|---|
| 3,461,951 | 8/1969 | Szentaszloi | 164/269 |
| 3,464,482 | 9/1969 | Greenberger | 164/426 |
| 3,817,316 | 6/1974 | Koch | 164/426 |
| 3,825,056 | 7/1974 | Grosko | 164/426 |

*Primary Examiner*—Richard B. Lazarus
*Assistant Examiner*—John S. Brown
*Attorney, Agent, or Firm*—Mandeville and Schweitzer

[57] ABSTRACT

The invention refers to a dolly for the starting or initiation strand of a metal strand casting plant, the dolly being equipped with guide pulleys at each end for a traction device embracing the pulleys and forming the drive for the initiation strand. The traction device includes a retractible support carrier for the starting or initiation strand. The support carrier has forwardly and rearwardly facing bearing surfaces which engage cooperating bearing surfaces on each end of an initiation strand for the engagement, support and positioning thereof. The invention eliminates the need for hoisting cranes of great height, and provides effective control of the initial feeding of the initiation strand to the casting mold.

10 Claims, 4 Drawing Figures

APPARATUS FOR HANDLING THE STARTING STRAND OF A METAL STRAND CASTING PLANT

BACKGROUND OF THE INVENTION

Such dollies serve the purpose of bringing the initiation or starting strand on the casting platform into a position in front of the strand casting mold. In this position, the initiation strand end is lowered into the strand casting mold with small movements of the initiation strand and/or dolly past the walls of the strand casting mold, which are not to be touched. The end of the initiation strand is lowered through the strand casting mold to the support roller stand arranged underneath, until it rests between the driven rollers of the support roller stand, and the initiation strand head, located at the bottom opening of the strand casting mold, has reached the position where it is sealed against the wall of the strand casting mold for the cast-on operation. The dolly thus serves primarily for the introduction of the initiation strand "from the top" into the strand casting mold, and secondly as a means of transport picking up the initiation strand at the casting platform edge from a hoisting unit, and transporting it to the strand casting mold. It has been suggested at times to have the initiation strand approach the strand casting mold suspended from a crane, and lower it vertically into the mold. It is understood that the crane for such operation must have a hoisting range which matches at least the length of the initiation strand. Such height is usually not found in most crane installations, and the dolly thus becomes an important piece of equipment for the operation of the strand casting plant.

A dolly for initiation strands of the above-mentioned kind is known in German disclosure 1.961.443 in which the dolly travels on the casting platform. However, details of such dolly are not shown and are not described.

STATEMENT OF THE INVENTION

The present invention provides a dolly with respect to the requirements of picking up the initiation strand from a hoisting unit, and positioning it favorably so that it may then be lowered without difficulties into the strand casting mold. This is done by providing a dolly with a roll-on and roll-off ramp or bearing surface for the initiation strand to be transported by means of several rollers arranged on top of the dolly, as well as the two front ends of the dolly, at intervals. The rollers form parallel rows in longitudinal direction of the dolly; by providing at least one retractable dog and/or support carrier in the roller traction device, and by providing that the carrier, in extended position, engages with the initiation strand where it can be locked in position. The invention also provides cutouts in both terminal areas of the initiation strand; and by providing forward and rear bearing surfaces on the carrier for cooperating counter surfaces in the cut-out of the initiation strand.

One advantage of the invention is the safe transfer of the initiation strand load from the hoisting unit at one front end of the dolly to the carrier. This pick-up is particularly critical due to the considerable weight of the initiation strand, which weighs up to 10 tons and over for slab strand casting plants. Another advantage is the lowering of the initiation strand into the strand casting mold. In both procedures, the cut-out or engagement opening in the initiation strand caught by the carrier is preferably located at the end of the initiation strand. During take-up, the weight of the initiation strand is progressively carried by the upper support rollers, and during the lowering process, the carrier is subjected to the load only during the last phase, where the weight is, in turn, received by the driven rollers of the support roller stand.

Symmetrical distribution of the initiation strand load, and consequently the absence of jolts during the pick-up, advancement and lowering are supported by providing the guide pulleys arranged at the dolly ends in pairs on an axis symmetrical with the center axis of the dolly in longitudinal direction, and by providing one row of support rollers each for the initiation strand outside the guide roller pairs.

The drive power is transmitted at greater efficiency of the transmission if an idler pulley is provided at the substructure of the traction device for the chain driving the dolly support rollers. The initiation strand supported at the outer areas of its width can, with advantageous power transmission, be engaged in the center, if the guide pulleys are designed as sprocket wheels and the traction devices as chains, and if a beam is fastened between the sprocket wheels arranged in pairs by means of an axle connecting adjacent chain links vertically to the running direction. On this beam pivots the support dog or carrier, designed as a one-armed lever with curved limited front and rear bearing surfaces.

The movement for lifting and lowering the initiation strand requires an apparatus capable of negotiating turns for pivoting the carrier, and the invention provides to this end that the pivoting carrier has a straight guide groove for a slide pin, or the like, hinged at the thrust or piston rod of an electrically driven straight thrust engine which is articulated at the beam with the housing containing the thrust rod. This makes it considerably easier to transfer the initiation strand suspended perpendicularly from the crane onto the dolly. Furthermore, the straight guide permits deflection of the load of the initiation strand weight from the straight thrust engine to stronger structural units.

An engagement of the carrier which allows both for pick-up and lowering of the initiation strand is achieved by adapting the curving limited front and rear bearing surfaces of the carrier to the engaging movement in the cut-out of the initiation strand, with the cut-out being formed in both power transmission directions by two circular limited bearing surfaces arranged opposite each other. The arched movement during lifting and lowering of the initiation strand from the crane onto the dolly, and from the dolly into the strand casting mold is provided by the advantageous carrier beam mounting with the beam seated in two axles joining the adjacent dolly drive chain links, the second axle sliding at the ends in a slot guide by means of an intermediate link attached to the chain link. This bearing for the beam can also be arranged, in accordance herewith so that one or several axles for the carrier beam rest on rollers in guide channels arranged on both sides of the dolly.

Since the dolly is to travel only a short stretch on the casting platform, energy is supplied by arranging on one side of the dolly a reel for electric energy cables connected to a drive transmission for the dolly, to a rotary gear for the guide pulleys, and to the electrically driven straight thrust engine.

An example of the invention is illustrated schematically on the drawings and is explained as follows:

DETAILED DESCRIPTION OF THE INVENTION

Figure 1:
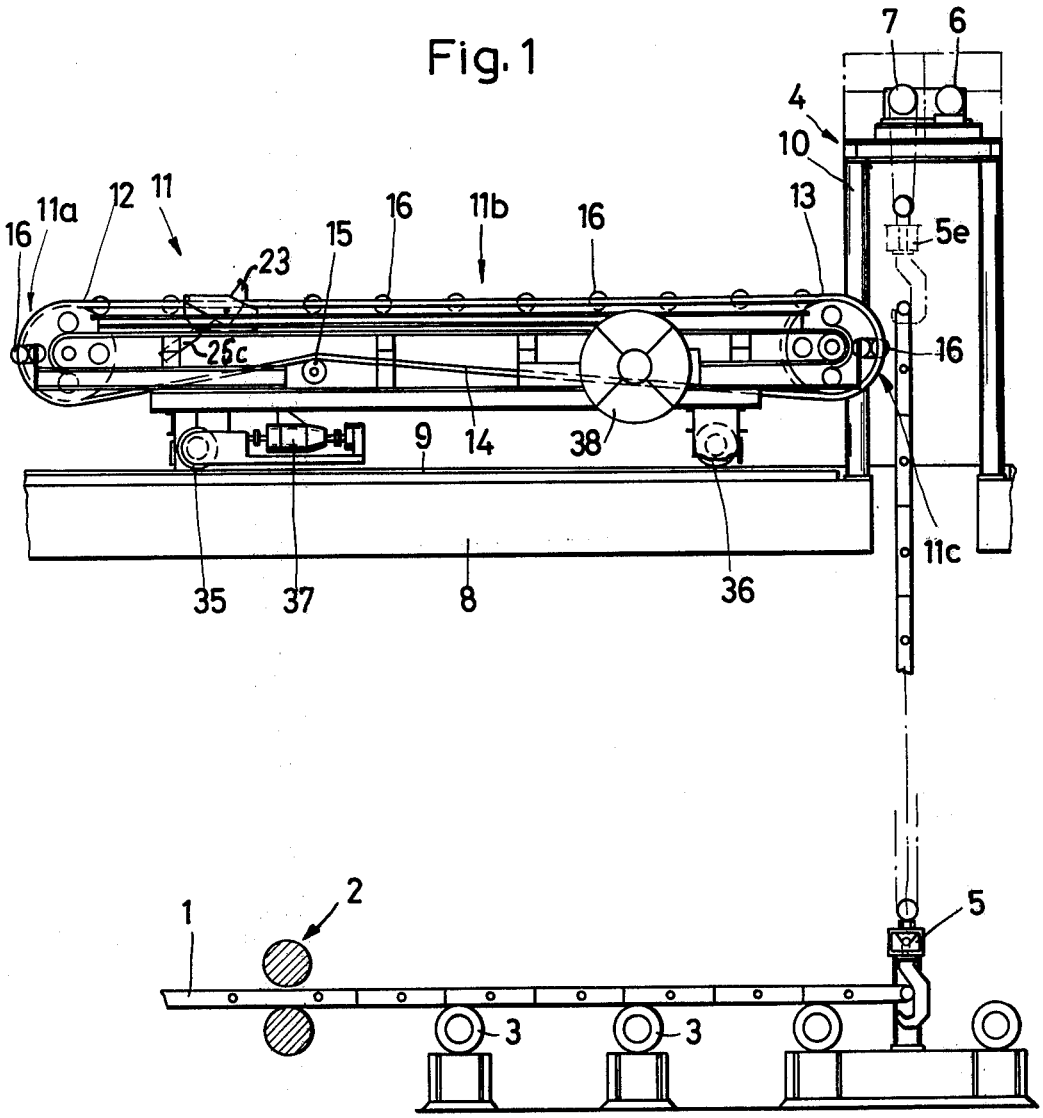
FIG. 1 is a schematic side elevational view of a dolly and associated crane structure illustrating the invention.
Figure 2:
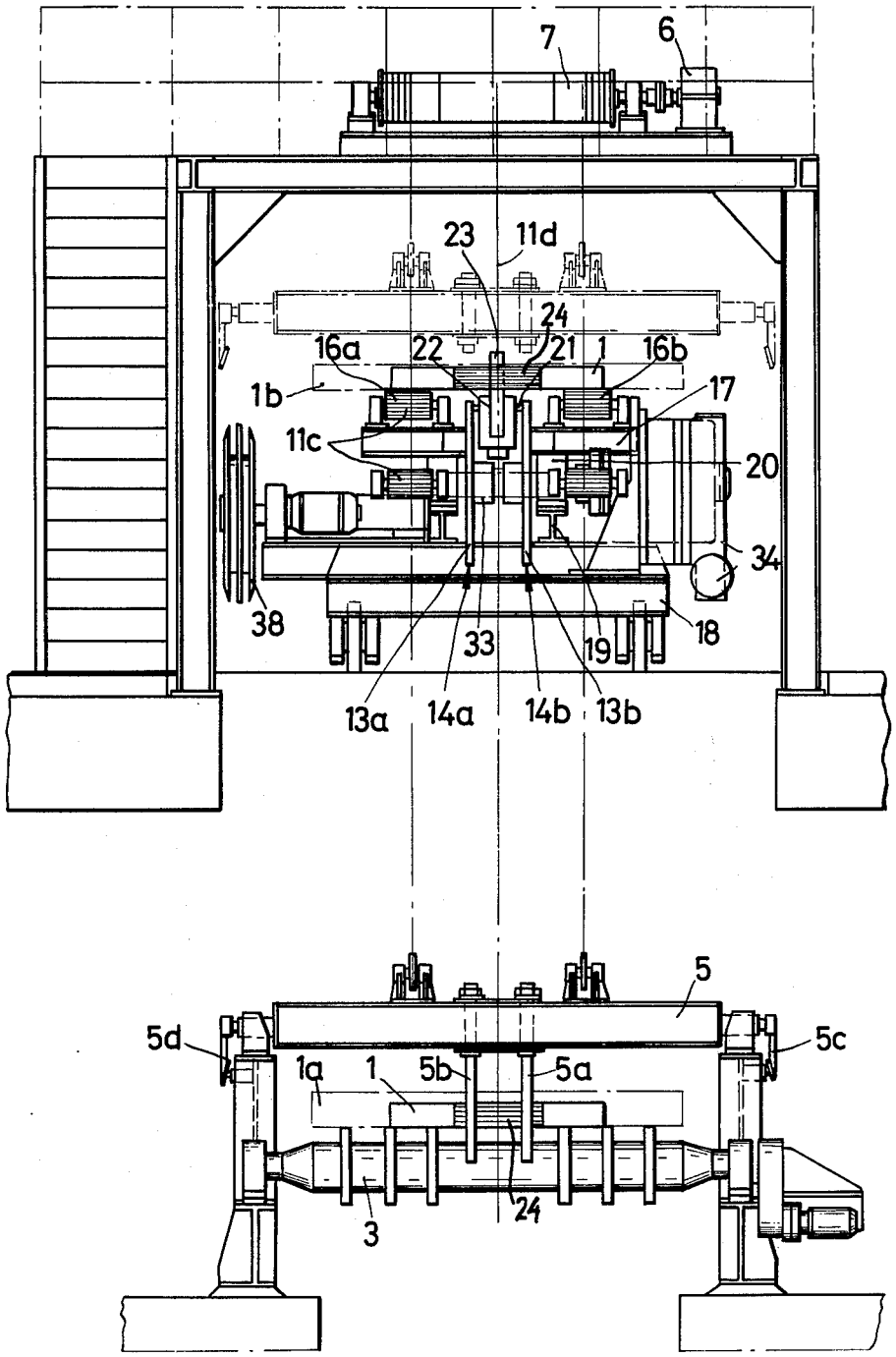
FIG. 2 is a right hand end elevational view of the apparatus of FIG. 1 enlarged.

Upon starting the casting procedure, the initiation strand 1 emerging from the curved part of a curved strand casting plant for steel, and driven by conveyor 2, arrives on rollers 3 of a roll-off ramp in the area of initiation strand hoisting unit 4. The hoisting unit 4 consists of hoisting crossbeam 5 with hooks 5*a*, 5*b* (FIG. 2). The contact made by hoisting crossbeam 5, by means of hoisting gear 6 via cable winch 7 activates electrical contacts 5*c*, 5*d* which initiate the lifting motion. Initiation strand 1 is raised, depending upon the casting velocity of casting strand 1*a* (FIG. 2), and upon disconnecting it from the casting strand, at greater speed to the perpendicular position shown on FIG. 1, where the hoisting crossbeam is positioned at 5*e*.

Rail track 9 is installed on casting platform 8 extending from hoisting unit 10 up to a strand casting mold not shown here. The advantage of dolly 11 is clearly visible in FIG. 1. Hoisting unit 10 exceeds casting platform 8 only by the amount necessary for the transfer of initiation strand 1 to dolly 11, including the structural height of hoisting unit 10 with hoisting gear 6, 7.

Guide pulleys consisting of sprocket wheels 12 and 13 are arranged at the ends of dolly 11. Chain 14, as the traction or driving device, embraces the sprocket wheels and can be adjusted to a favorable tractive force by means of idler pulley 15. The top 11*b* of dolly 11 is provided with support rollers 16. Support rollers 16 are arranged in rows 16*a* and 16*b* (FIG. 2) on props or brackets 17. Props 17 form a part of dolly frame 18 made up of frame parts 19 and 20. The rows of rollers 16*a* and 16*b* go from front face 11*a* over the top 11*b* of dolly to rear face 11*c*. In each case, the lowest support roller 16 forms with the following higher roller 16, depending on distance, a round, oval or oblique bearing, which acts as a roll-off ramp at the front face 11*a* and as roll-on ramp at rear face 11*c*.

The distances of rows of rollers 16*a* and 16*b* are determined by the width of the initiation strands. FIG. 2 shows one initiation strand 1 of minimum width and one initiation strand 1*b* of maximum width in dash-dot lines. Sprocket wheels 13*a* and 13*b* are advantageously arranged between rows of rollers 16*a* and 16*b*. This arrangement permits the use of initiation strands of differential width, and furthermore, the connection of chains 14*a*, 14*b* by means of connecting bars or axles 21, permits arrangement of beam 22 supported on the axles, and arrangement of carrier 23 supported on the beam. This provides carrier 23 with a good grip on initiation strand 1 on dolly center axis 11*d*.

Figure 3:
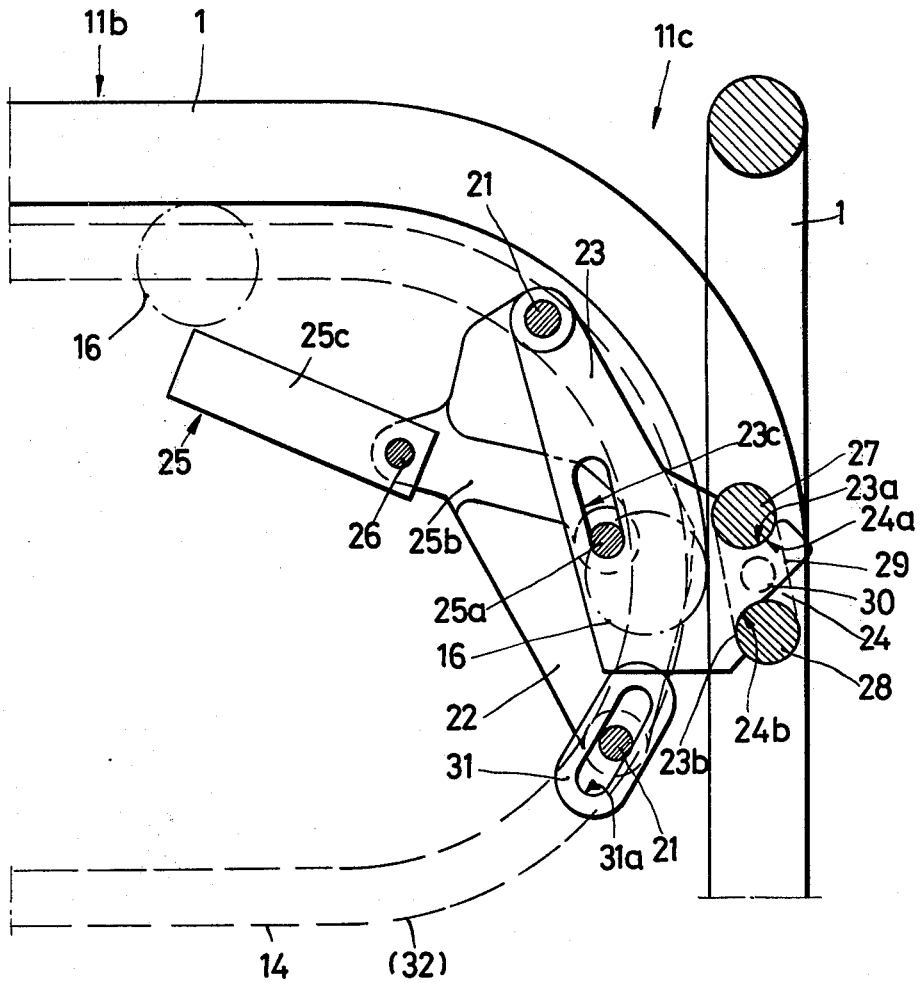
FIG. 3 is an enlarged detailed showing of the support carrier of the invention in elevation.
Figure 4:
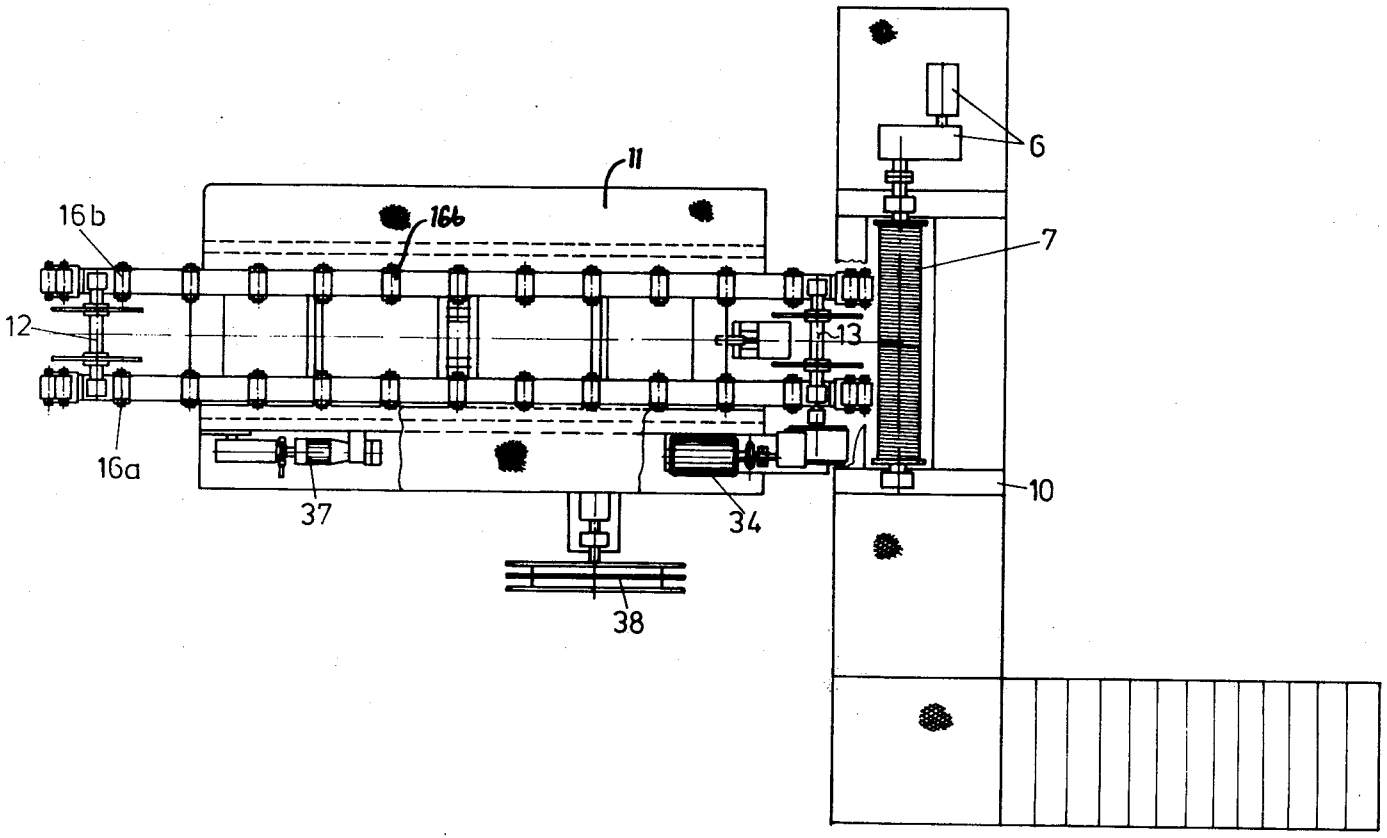
FIG. 4 is a top plan view of the apparatus of FIG. 1.

FIG. 3 shows initiation strand 1 in vertical position in which it is engaged by carrier 23 and pulled on top 11*b* of dolly 11 into the position shown in dash-dot lines. For this purpose, initiation strand 1 starts by being suspended in hoisting hooks 5*a* and 5*b*, In this position, carrier 23 catches in the hole or cut-out portion 24 in initiation strand 1 and receives the weight of the latter with its front bearing surface 23*a*, while hoisting hooks 5*a*, 5*b* are being lowered. For the purpose of performing this movement, carrier 23 pivots on upper axle 21 shown in FIG. 3 and which forms one chain link axis at the same time. Carrier 23 is equipped with a straight groove 23*c*, in which slides pin 25*a* of thrust rod 25*b* (symbolized by dash-dot lines) of the electrically driven reversible push-pull or straight thrust engine 25. Engine housing 25*c* is attached on beam 22 by means of pivot joint 26.

In extended position of thrust rod 25*b* carrier 23 is pivoted into cut-out 24. In retracted position, pin 25*a* is displaced in straight groove 23*c*, and carrier 23 is disengaged from cut-out 24. In cut-out 24 in initiation strand 1 two rods 27 and 28 with circular cross section are supported and they are connected via lateral or side tabs 29. Each lateral tab 29 is mounted to rotate at 30. The unit formed by rods 27, 28 and tabs 29 rotates around axis 30 in the cut-out 24 in order to facilitate catching or releasing of carrier 23 when carrier 23 is thrust into cut-out 24 between rods 27, 28. Shape and position of counter surfaces 24*a*, 24*b* in cut-out 24 of initiation strand 1 depend on the desired catching and releasing movement, and the basic shape selected for carrier 23.

The situation depicted on FIG. 3 around the carrier 23 is maintained during the course of the travel made by initiation strand 1 driven by chains 14*a*, 14*b* on guide pulleys 12 and 13 from rear face 11*c* up to front face 11*a*. At this point, initiation strand 1 lies on the dolly on roller rows 16*a*, 16*b* with the end in the position as shown in FIG. 3. In this situtation the dolly can travel on rail track 9.

Before lowering initiation strand 1 into the strand casting mold from the top, the straight thrust engine 25 is activated again, thrust rod 25*b* is retracted so that carrier 23 releases the cut-out 24, the guide pulleys run in opposite direction until beam 22 together with carrier 23 are in engaging position below a second cut-out 24 (not shown) at the rear end of initiation strand 1. In this position the straight thrust engine 25 is again activated and thrust rod 25*b* pivots carrier 23 into the rear cut-out in initiation strand 1 (not shown), which essentially matches cut-out 24. It is of great importance that counter surface 24*b* in this situation takes on the weight of initiation strand 1, via carrier 23, while initiation strand 1 is being lowered. Carrier 23 is used as a hold during this lowering process in order to avoid accelerated dropping of the initation strand into the strand casting mold.

Beam 22, in accordance with the first example, is arranged at chain 14 by means of axle 21 shown to be on top in FIG. 3. Lower axle 21 is arranged at chain 14 by means of intermediate link 31 connected to a chain link in chains 14*a*, 14*b*. Slot guide 31*a* permits balancing movements between the curved and straightened chain portions.

In a second embodiment, chain 14 is coordinated with a guide channel 32 following its arched portion, such channel 32 guiding axles 21 by means of rollers. It is also possible to provide chains with variable chain division in order to balance the length differential between the degree of arc, and the straightened chain portions. In a third embodiment, guide pulleys 12 and 13 are designed as ropes and serve to drive movable beam 22. In this case, hubs 33 of guide pulleys 12 and 13 are driven by chains 14.

The guide pulleys themselves have a rotary drive 34. At least one drive transmission 37 is provided for wheel pairs 35 and 36 (FIG. 1) of dolly 11. The electric energy supplied for all drives is conducted by wires gathered in groups on reel 38.

I claim:

1. A dolly for supporting, guiding and positioning a starting strand of a metal casting plant, comprising (a) a dolly body;

(b) guide pulley means positioned at each end of said body;

(c) traction belt means extending over said guide pulley means;

(d) power means connected to said pulley means for driving said pulley means; the improvement characterized by (e) a plurality of pairs of support rollers spaced along the top surface and the front and rear edges of said body;

(f) said pairs of said support rollers forming parallel rows longitudinally of said body;

(g) a retractible carrier connected to said traction belt means, said carrier in extended position engaging a starting strand on said dolly; and (h) forwardly and rearwardly facing bearing surfaces on said retractible carrier;

(i) said bearing surfaces supporting and guiding a starting strand on said dolly upwardly onto said dolly, and over and downwardly into a casting strand path.

2. The apparatus of claim 1, further characterized by (a) said guide pulley means are a pair of guide pulleys at each end of said dolly;

(b) said guide pulleys of each pair positioned equally spaced on each side of the longitudinal axis of said body;

(c) said parallel rows of support rollers are positioned on each side of said longitudinal axis outside said guide pulley pairs; and (d) said traction belt means are a pair of traction belts.

3. The apparatus of claim 2, further characterized by (a) said axle being two axles with one each extending on each side of said carrier support beam;

(b) rollers on the end of one of said axles opposite said carrier support beam;

(c) a guide channel disposed on one side of said dolly; and (d) said axle rollers engaging said guide channel.

4. The apparatus of claim 2, further characterized by (a) each of said guide pulleys is a sprocket wheel;

(b) each of said traction belts are a chain;

(c) an axle extending between said chains;

(d) a carrier support beam centered on said axle, said retractible carrier pivotally mounted on the support beam;

(e) said carrier is a one arm lever; and (f) said bearing surfaces are curved.

5. The apparatus of claim 4, further characterized by (a) said axle being two axles with one each extending on each side of said carrier support beam to one said chain;

(b) an intermediate link connected to one said chain;

(c) a guide slot in said intermediate link; and (d) the end of one said axle opposite said carrier support beam engaging said intermediate link guide slot.

6. The apparatus of claim 4, further characterized by (a) a straight thrust engine;

(b) a thrust rod on said engine;

(c) a guide pin on said thrust rod;

(d) a guide groove on said pivotal carrier, said guide pin slidable in said groove; and (e) said engine articulated on said support beam.

7. The apparatus of claim 6, further characterized by (a) a drive motor connected to said dolly;

(b) an electrical energy cable handling reel mounted on one side of said dolly; and (c) said reel holding and supplying cable length connection for the electrical cables of said drive motor, said straight thrust engine and said pulley power means during movements of said apparatus.

8. The apparatus of claim 1, further characterized by (a) an adjustable idler pulley in said traction belt path for adjusting the tension thereof.

9. The apparatus of claim 1, further characterized by (a) an elongated starting strand with openings at each end thereof.

(b) opposed forwardly and rearwardly facing counter bearing surfaces in each said opening; and (c) said counter bearing surfaces cooperating with said bearing surfaces on said carrier for the engagement of said starting strand by said carrier.

10. The apparatus of claim 9, further characterized by (a) said cooperating bearing and counter bearing surfaces are curved surfaces of limited extent.

* * * * *